US005351673A

United States Patent [19]

Somerton

[11] Patent Number: 5,351,673

[45] Date of Patent: Oct. 4, 1994

[54] RV STOVE SPATTER GUARD

[75] Inventor: Michael G. Somerton, Goodlettsville, Tenn.

[73] Assignee: CAMCO Manufacturing, Inc., Greensboro, N.C.

[21] Appl. No.: 79,981

[22] Filed: Jun. 18, 1993

[51] Int. Cl.[5] ..... F24C 15/10

[52] U.S. Cl. ..... 126/214 D; 126/299 C

[58] Field of Search ..... 126/214 D, 299 C

[56] References Cited

U.S. PATENT DOCUMENTS

| | | | |
|---|---|---|---|
| 3,713,432 | 1/1973 | Finley | 126/38 |
| 3,789,821 | 2/1974 | Fick | 126/38 |
| 4,426,990 | 1/1984 | Shepherd | 126/9 B |

*Primary Examiner*—Carroll B. Dority

[57] ABSTRACT

A spatter guard (10) which attaches to recreational vehicle folding stove top covers (18) having a hook (12) and a magnetic strip (15) so as to engage either magnetic or non-magnetic types of covers.

12 Claims, 1 Drawing Sheet

RV STOVE SPATTER GUARD

BACKGROUND OF THE INVENTION

1. Field of the Invention

This invention relates to spatter guards or shields designed to protect counter and wall surfaces adjacent to cooking stoves from spatters and splashes resulting from cooking or food preparation, and more specifically to such guards designed for use with cooking stoves commonly installed in recreational vehicles.

2. Description of Prior Art

Several methods have been devised to protect kitchen walls and counters from spatters and splashes resulting from cooking or preparing food, ranging from washable panels applied to the wall to various devices mounted either on the counter or on the stove.

Camping stoves normally used out of doors frequently have wind screens or guards attached to protect the flame from breezes while cooking.

In recreational vehicles, space is restricted and the cookstove with its spatters and splashes is closer to wall and counter surfaces than in most homes.

Due also to the constricted space and the tendency to utilize recreational vehicles more during hot weather, the RV air conditioning unit will usually be turned on creating unwanted side drafts which affect the burner flame.

Spatter guards designed for use in recreational vehicle kitchens are generally of three types:

(a) Counter-mounted, having a right-angled flange along the bottom edge in which holes are drilled to attach guard to counter top with screws.

(b) Stove-mounted, consisting of three panels hinged together, so that when formed into a "U" shape the guard will stand on top of the stove around a burner in use, or if formed into an "L" shape the guard can stand on the counter top around the back and one side of the stove.

(c) Stove cover-mounted. There are some RV cookstoves equipped with folding stove covers having two hinged guards attached to the sides of the cover to stand on either side of the stove when the cover is opened for cooking.

Stove covers are in general use in recreational vehicles due to the very limited working/counter space available. The most popular type of stove cover is a folding metal cover which opens and provides a rear splash guard for cooking, and which closes at other times to conceal the cook top and to provide added counter space.

Most folding metal stove covers are constructed of steel, either polished or powder coated. Some are of highly polished stainless steel.

No spatter shields presently available are of a type which attach to the folding metal stove covers so popular with recreational vehicle owners.

OBJECTS AND ADVANTAGES

Accordingly, besides the objects and advantages of spatter guards described above, several objects and advantages of the present invention are:

(a) to provide a set of spatter guards which attach to the metal folding stove covers frequently used on cooking stoves installed in recreational vehicles;

(b) to provide spatter guards which attach firmly to painted or polished steel folding stove covers by means of hooks or magnetic strips, and are easily removable when cooking is finished and the stove covers are to be closed;

(c) to provide spatter guards which also attach by means of hooks to the genuine stainless steel stove covers used by many recreational vehicle owners who frequent coastal areas.

DRAWING FIGURES

OPERATION

The manner of using the spatter guards is to attach them to a metal folding stove top cover when cover is in the fully opened position.

If the stove top cover is made of a metal which supports magnetic attraction, attach spatter guards with magnetic strips provided.

For stainless steel stove top covers, use the hooks at top corners of spatter guards.

SUMMARY, RAMIFICATIONS AND SCOPE

Accordingly, the reader will see that the spatter guards of the present invention provide:

(a) simple attachment to the folding metal stove top covers in general use on cook stoves in recreational vehicles;

(b) dual attachment means so that the spatter guards attach equally well to either coated steel or stainless steel folding stove top covers;

(c) spatter guards which are effective in protecting walls, counter top and stove top from cooking splashes and spatters;

(d) spatter guards which are quickly and easily removable when cooking is finished, and which are very compact for easy storage when not in use.

DESCRIPTION OF THE PREFERRED EMBODIMENT

Figure 1:
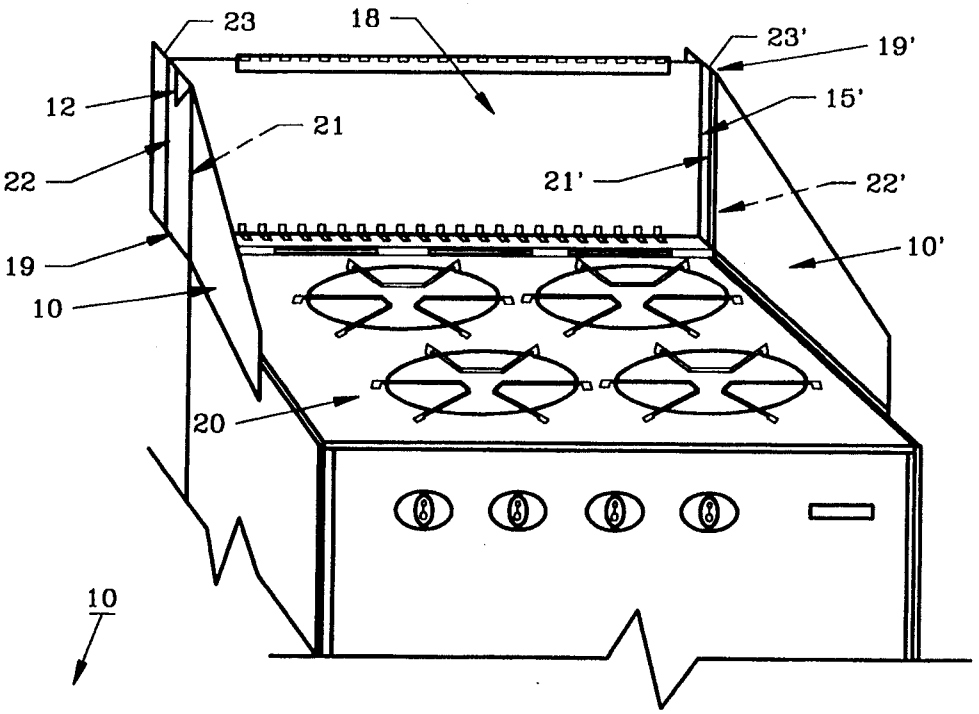
FIG. 1 shows a perspective view of a pair of spatter guards attached to a folding stove cover.
Figure 2:
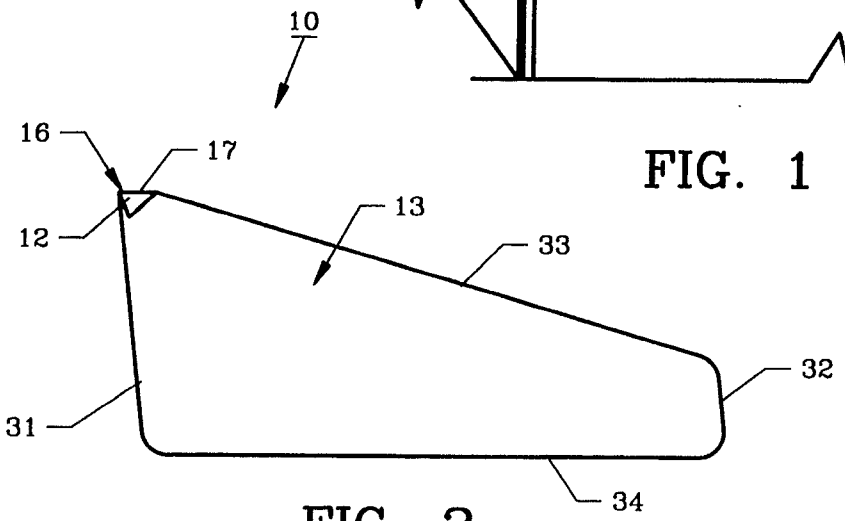
FIG. 2 is left side view of spatter guard showing hook.
Figure 3:
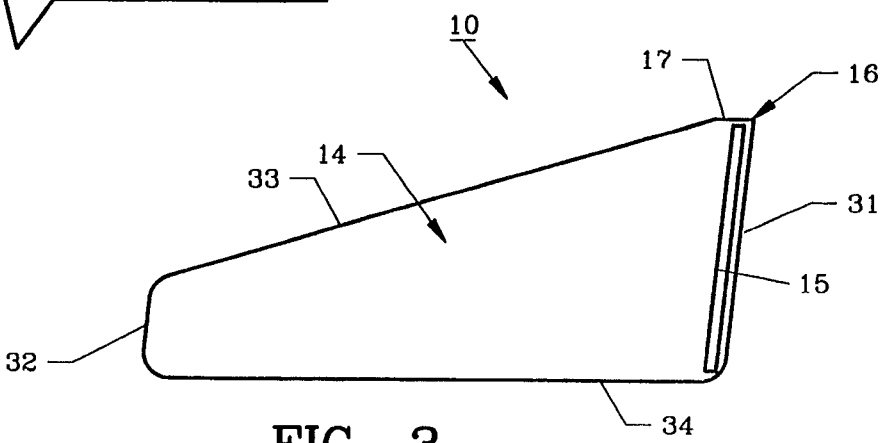
FIG. 3 is right side view of spatter guard showing attached magnetic strip.

The preferred embodiment of the invention is depicted in FIGS. 1–3, whereby a recreational vehicle stove spatter guards 10, 10' are formed from a planar sheet of metal. FIG. 1 shows spatter guards 10, 10' attached to side flanges 19, 19' on a typical folding stove top cover 18, which is used to cover recreational vehicle stove top 20. Upon folding stove top cover 18 away from stove top 20 so that cover 18 sits vertically at the back of stove top 20, side flanges 19,19' extend forwardly and the inner surfaces 21, 21' (21 not visible), outer surfaces 22, 22' (22' not visible), and top edges 23, 23' thereof are exposed. Spatter guards 10, 10' are shown attached to side flanges 19, 19' respectively. Spatter guard 10 is positioned against the inner surface 21 (not visible) of side flange 19 and is attached by hook 12, which fastens over top edge 23 and contacts outer surface 22 of side flange 19. This method of attachment works equally well for stove top covers and spatter guards composed of any of a variety of materials, since such hook holds the spatter guard in place regardless of the composition.

FIG. 1 also depicts spatter guard 10' magnetically held in place to stove top cover 18. Here magnetic strip 15' can be seen affixed to spatter guard 10'. Magnetic strip 15' holds spatter guard 10' to the outer surface 22' (not visible) of side flange 19'. This method of attachment works well for attaching spatter guards to stove top covers composed of a magnetically-attractive metal. As is understood by examining FIG. 1, spatter guard 10 also has magnetic strip 15, which is hidden from view, and spatter guard 10' also has hook 12', which is hidden from view. Spatter guards 10 and 10' are constructed as mirror images of each other so that they both can be positioned against either the inner surfaces 21, 21' or outer surfaces 22, 22' of side flanges 19, 19', using either means of attachment: hooks 12, 12' or magnetic strips 15, 15'.

FIG. 2 provides a closer view of first surface 13 and hook 12 of spatter guard 10. Spatter guard 10 is of a quadrangular, trapezoidal shape having relatively tall back edge 31 substantially parallel to relatively short front edge 32 and top edge 33 not parallel to bottom edge 34. Top edge 33 and back edge 31 define acutely angled corner 16, which has the smallest angle of the corners of spatter guard 10. Hook 12 is formed by folding acutely angled corner 16 approximately 180 degrees along fold line 17 toward first surface 13 so that hook 12 is of an inverted triangular shape and is downwardly directed, pointing at bottom edge 34. As can be seen, fold line 17 is substantially parallel to bottom edge 34. As would be understood, hook 12 is spaced slightly from first surface 13, approximately the same distance as the thickness of spatter guard 10, so that hook 12 can easily fit over the top edge 23 of flange 19, as depicted in FIG. 1.

FIG. 3 depicts the spatter guard 10 of FIG. 2 rotated 180 degrees so that second surface 14 and elongated magnetic strip 15 are visible. Magnetic strip 15 is approximately the same length as back edge 31 and is affixed to second surface 14 adjacent back edge 31 and proximate acutely angled corner 16.

Therefore I claim:

1. A spatter guard in combination with a recreational vehicle folding stove top cover, the stove top cover having side flanges that extend forwardly when the stove top cover is folded up away from the stove top, the side flanges each having inner and outer surfaces and top edges, the spatter guard comprising:

(a) a planar quadrangular sheet, said sheet having a first surface and a second surface , and (b) means for attaching said sheet to said stove top cover , said attaching means comprising a hook, said hook spaced from said first surface of said sheet, said attaching means also comprising an elongated magnetic strip, said strip affixed to said second surface of said sheet .

2. The combination of claim 1 wherein said hook is formed from a downturned corner of said quadrangular sheet.

3. The combination of claim 2 wherein said hook is attached to one of said stove top cover side flanges.

4. The combination of claim 1 wherein said elongated magnetic strip is adjacent an edge of said quadrangular sheet.

5. The combination of claim 1 wherein said magnetic strip is magnetically attached to one of said stove top cover side flanges.

6. The combination of claim 1 wherein said quadrangular sheet is trapezoidal.

7. The combination of claim 1 wherein said quadrangular sheet is positioned against said inner surface of said side flange with said hook contacting said outer surface of said flange.

8. The combination of claim 1 wherein said quadrangular sheet is positioned against said outer surface of said side flange with said magnetic strip contacting said outer surface of said side flange.

9. A recreational vehicle stove spatter guard for attachment to side flanges on an opened recreational vehicle stove top cover, the guard comprising a planar quadrangular sheet, said sheet having a relatively tall back edge and a relatively short front edge, said back and said front edges substantially parallel to one another, said sheet also having non-parallel top and bottom edges, said sheet additionally having first and second planar surfaces, said top and back edges defining an acutely angled corner, said acutely angled corner folded approximately 180 degrees to form a hook, said hook having an inverted triangular shape, said hook downwardly directed, and an elongated magnetic strip, said magnetic strip affixed to said second surface.

10. The spatter guard of claim 9 wherein said magnetic strip is approximately the same length as said back edge.

11. The spatter guard of claim 9 wherein said acutely angled corner defines a fold line, said fold line substantially parallel to said bottom edge.

12. The spatter guard of claim 9 wherein said hook is spaced from said first surface a distance approximately the same length as the thickness of said sheet.

* * * * *